US005427121A

United States Patent [19]

Polito

[11] Patent Number: 5,427,121

[45] Date of Patent: Jun. 27, 1995

[54] SPRAY ON NAIL POLISH

[75] Inventor: Joyce H. Polito, Fountain Hills, Ariz.

[73] Assignee: Phil Polito & Company, Inc., Phoenix, Ariz.

[21] Appl. No.: 94,573

[22] Filed: Jun. 22, 1993

[51] Int. Cl.[6] ..... A45D 29/00

[52] U.S. Cl. ..... 132/200; 132/285

[58] Field of Search ..... 132/285, 200, 73

[56] References Cited

U.S. PATENT DOCUMENTS

| | | | |
|---|---|---|---|
| 1,564,806 | 12/1925 | Weider . | |
| 2,722,224 | 11/1955 | Blann | 132/285 |
| 3,461,885 | 8/1969 | Coveney | 132/285 |
| 3,598,685 | 8/1971 | Lee et al. | 132/73 |
| 3,885,578 | 5/1975 | Hicks | 132/73 |
| 3,898,357 | 8/1975 | Miller et al. | 132/73 |
| 4,187,204 | 2/1980 | Howard | 260/22 CB |
| 4,577,648 | 3/1986 | Dinerstein et al. | 132/73 |
| 4,844,855 | 7/1989 | Chernack | 424/61 |
| 4,960,587 | 10/1990 | Rucker | 132/285 |
| 4,974,610 | 12/1990 | Orsini | 132/285 |
| 5,088,903 | 2/1992 | Tomatsu | 417/473 |
| 5,133,369 | 7/1992 | Billings | 132/200 |
| 5,143,100 | 9/1992 | Kawakami | 132/285 |
| 5,150,726 | 9/1992 | Rucker | 132/285 |
| 5,209,250 | 5/1993 | Taeckens | 132/200 |
| 5,269,330 | 12/1993 | Hayes | 132/200 |

OTHER PUBLICATIONS

Modern Salon Apr. 1986, p. 136.

*Primary Examiner*—Paul J. Hirsch

*Attorney, Agent, or Firm*—David G. Rosenbaum

[57] ABSTRACT

A method for applying color to the surface of nails of the hands and feet is provided in the form of a base coat, acrylic spray paint and a top sealing coat. The method is performed by first applying a base coat in the usual method to the nail surface, spraying the acrylic paint on the nail surface and then sealing the acrylic paint by applying a top coat. Once the top sealing coat is dry, the user washes her hands with soap and water so as to remove any overspray of acrylic paint which came into contact with the surrounding skin or cuticle. The system can be used in association with finger shields which would serve to protect the surrounding skin and cuticle or in association with stencil designs.

11 Claims, 2 Drawing Sheets

SPRAY ON NAIL POLISH

FIELD OF THE INVENTION

This invention relates generally to the field of cosmetics for enhancing one's appearance and is directed to a method for applying spray-on nail polish to the surface of a fingernail or toenail. More particularly, the present invention relates to a method for applying a coating of acrylic paint to the surface of a fingernail or toenail, by spraying the acrylic paint from an aerosol canister. To further define the application of color, the use of shields and stencil designs can be incorporated into the spraying application.

BACKGROUND OF THE INVENTION

It is common practice throughout the world today for individuals to enhance and beautify their fingernails and toenails through the application of color on the surface of the nail. This application is commonly done through the use of various nail enamels. The current most common method for this application is done by applying the nail enamel with an applicator brush to the nail surface. This method takes time and often does not accomplish the preferred effect due to imperfections in the enamel or in the method of application.

This current method of brushing nail enamel on the surface of one's nails, encounters numerous other difficulties when the individual is not ambidextrous. Unless proficiency is attained, this procedure of brushing the enamel on the left and then right hand is most difficult to accomplish.

In recent years the use of acrylic paints for color application to nails has come into use. The use of spray-on acrylic paints allows the professional to create designs not previously known with brush-on enamel paints. The use of spray-on acrylic paints permits the fading in and out of colors, previously accomplished only with the use of airbrushes. The use of an airbrush and compressor in color application to the surface of fingernails and toenails has not been shown to be economical due to its initial outlying cost, nor feasible for continued use in the application of color to fingernails and toenails. Furthermore, due to the necessity in thoroughly cleaning an airbrush between paint colors and time necessary to be expounded in doing so, the use of an airbrush would not lend itself to use in the application of nail color to overall surface of fingernails and toenails.

This invention presents itself to fulfill the need for a method for the application of color and designs to the surface fingernails and toenails in an improved, more economical and less time consuming way. Moreover, this method allows for the individual to use numerous colors in the application, thus achieving a fading in and out of the color or colors, something not achievable through the use of current brush-on nail enamel methods. This method additionally allows for lessened drying time of color due to the application of a top drying coat, and easier cleanup around the surrounding nail tissue and cuticle with soap and water.

SUMMARY OF THE INVENTION

A method is presented which provides for the application of color to fingernails and toenails through the use of spray-on acrylic paints. Prior to the application of acrylic paints, the nail surface is prepared by applying a basecoat or primer. This application of base coat or primer is achieved through current practice of applying nail enamels. It is anticipated by this disclosure to apply the base coat or primer through a spraying action, through the use of an aerosol canister and nail shields. Once the base coat or primer is dry, the acrylic paint is sprayed on the surface of the fingernail or toenail. This step in the application of color may be modified to allow the fading in and out of various colors. Subsequent to the application of acrylic paint to the nail surface, a top coat is applied on the acrylic paint coated nail surface. Again, it is anticipated by this disclosure to apply the top coat through a spraying action, through the use of an aerosol canister. This application of a top coat seals the previously applied acrylic paint. Once dry, the unsealed sprayed on acrylic paint remaining on the surrounding skin or cuticle surface is water receptive, thus allowing for any residue of the paint sprayed on the surrounding nail tissue or cuticle to be easily removed by thoroughly washing with soap and water. This cleansing of the surrounding nail tissue and cuticle must be done subsequent to the application of the top coat to the nail surface. The present invention additionally allows for an expanded method of the application of color to the nail incorporating the fading in and out of colors, as previously stated, and in the use of preformed stencil designs.

An alternate method for applying the nail color is disclosed and comprised of initially applying a base coat to the fingernail or toenail. Once the base coat is dry, the user can optionally apply a nail shield to protect the surrounding nail tissue and cuticle area and underside of nail from any overspray of the acrylic paint. In the alternative, the protective nail shield can initially be applied to the nail tissue sought to be protected prior to the application of the base coat. Once the application of the base coat and the optional nail shield is achieved and the base coat dry, the color acrylic paint is applied to the nail surface in a spraying manner. Any number of colors may be applied to achieve numerous artistic qualities and designs through technique or through the use of nail stencil designs. Various methods of applying designs to nails are utilized by individuals in nail art and anticipated in this disclosure. Once the application of desired color and design have been achieved, the top coat is applied, as previously disclosed to seal the acrylic paint.

The method for achieving designs through the use of stencils and spray color application is to apply the tacky backed nail stencil to the nail surface, prior to the application of the topcoat sealer and spray with acrylic color to enhance the design and allow it to be visible and distinct from the surrounding color on the nail.

The method of the present invention allows for accurate and faster color application to surface of fingernails and toenails and if chosen the blending of colors or application of various designs.

DETAILED DESCRIPTION OF THE PREFERRED EMBODIMENT

Figure 1:
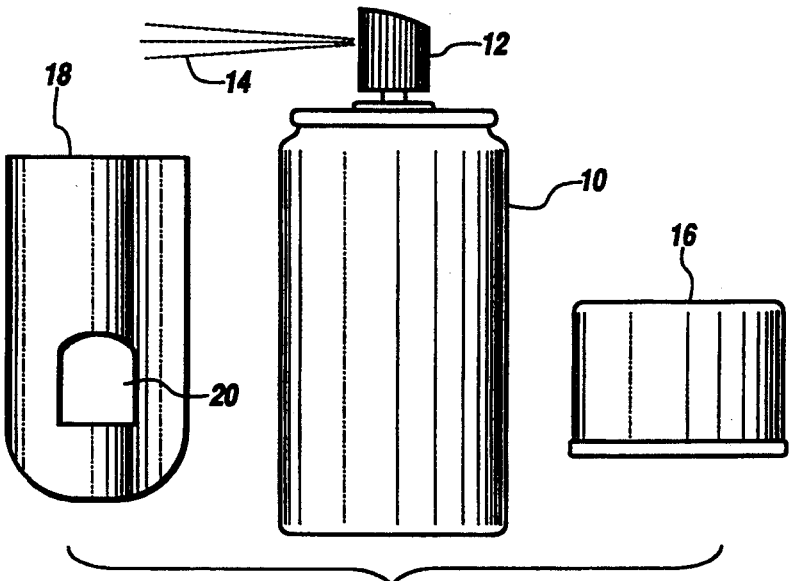
FIG. 1 is a top view of a shield used in the inventive method, a front view of the spray-on nail polish contained in an aerosol can and accompanying cap.
Figure 2:
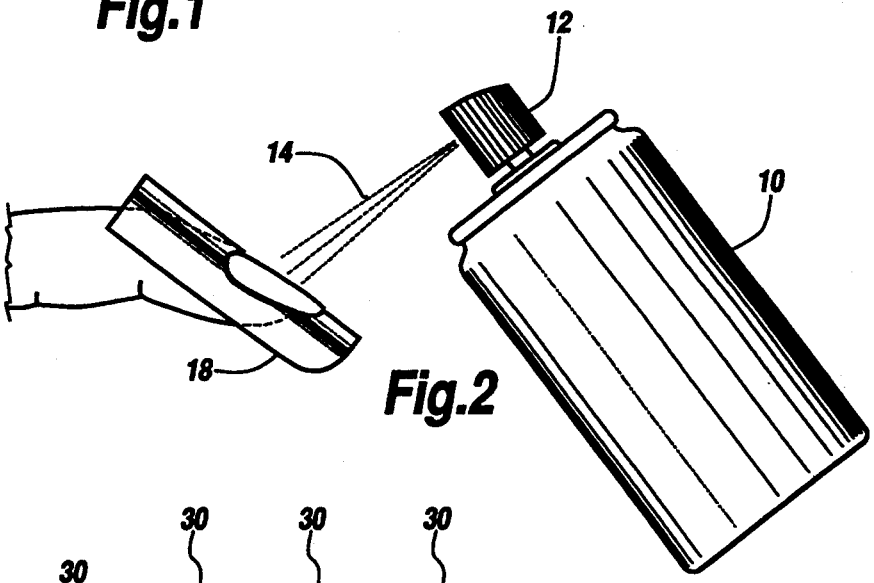
FIG. 2 depicts a step in the method of acrylic paint color application to the nail surface with finger shield in place.

As required, detailed illustrative embodiments of the invention are disclosed herein. The present invention finds its most advantageous color application in the form of an acrylic paint sprayed from an aerosol can. However, it is to be acknowledged that this embodiment merely exemplifies the present invention which may take forms different from those embodiments disclosed. In accordance with the preferred embodiment of the present invention, as illustrated in FIGS. 1 and 2, there is provided an aerosol can 10 and cap 16 of standard construction, having a plastic spray nozzle 12 for application of color to the nail surface in the form of acrylic paint 14. The acrylic paint 14 formula is chemically formulated to be environmentally safe. The concentrate of the aerosol consists of an acrylic copolymer paint that is blended with Ketones in the form of solvents and straight carbon chained alcohols. The propellant used in the aerosol is a DME, Dimethyl Ether, which additionally produces a fast drying acrylic paint 14.

The acrylic paint 14 can be sprayed directly on the nail surface without the use of a finger shield 18 or with the use of a finger shield 18 as shown in FIGS. 1 and 2. The finger shield 18 is preferably comprised of foil paper, approximately one and one quarter inch wide and two inches long having an oblong aperture 20 defined therein for positioning of the nail through the oblong aperture 20 and resting on the surrounding skin. As disclosed, the finger shield 18 has an adhesive coating applied to the back side and is suitable for holding the finger shield 18 in place due to its adherence on the surrounding nail tissue. The adhesive coating applied to the back side of the finger shield 18 is pressure sensitive and does not allow for displacement of the finger shield 18 while the acrylic paint 14 is being applied to the nail surface. This positioning of the finger shield 18 about the nail surface allows for the surrounding nail tissue and cuticle to be protected from overspray of acrylic paint 14. The finger shield 18 is removed after allowing the acrylic paint 14 color application to dry or partially dry.

Figure 3:
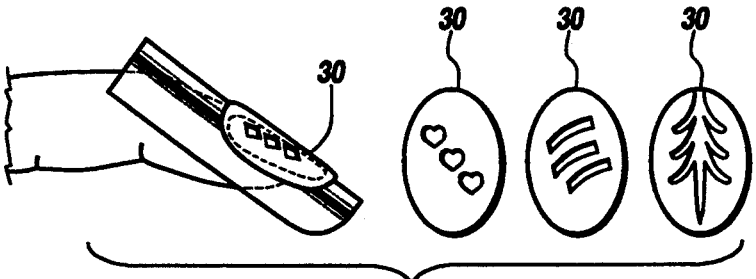
FIG. 3 shows a finger shield and stencil design in place on the fingernail and an example of alternative stencil designs.

Enhanced color techniques and designs can be accomplished either through the use of numerous colors in a fading in and fading out technique or through the use of stencils 30. As shown in FIG. 3, disclosed is the use of stencils 30 for use in creating designs of a determinate shape on the surface of the nail. The stencils 30, are made of a light bendable plastic with an adhesive backing, capable of conforming to the nail surface shape. The designs can be in the shape of hearts, dots, stripes, etc. which are formed into the plastic. In use, the stencil 30 is placed directly on the nail surface, after the base coat, either prior to any color application or after color application. The provided adhesive backing on the stencil 30 allows for proper positioning on the nail surface. Once positioned, a subsequent color application is applied to define the design of the stencil 30 on the nail surface. The stencil 30 is removed once the desired color application has been achieved and before the top coat is applied. In addition shown in FIG. 3 are a sampling of alternative choices of stencils 30.

Figure 4:
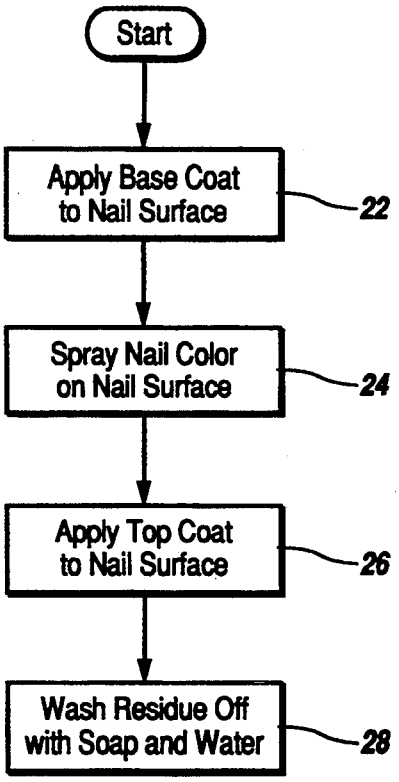
FIG. 4 is a flow chart showing the method for applying spray-on nail polish without the use of a shield or stencil design.

Shown in FIG. 4 is the preferred method for application of the spray-on acrylic nail color without the use of shield 18 or stencil 30. Prior to the acrylic paint 14 application to the nail surface, a base coat is applied 22 for enhanced paint adherence. The base coat is applied on in a manner consistent with current practice of applying nail enamels.

The acrylic paint 14 is next applied by spraying 24 acrylic paint 14 directly on the nail surface using a spraying technique most suitable to achieving the desired color results.

After the acrylic paint 14 application to the nail surface, a top coat is applied 26 which serves as a waterproof sealant and protectant to the acrylic paint 14. The top coat acts as a waterproof sealant and protectant applied to the nail surface, thus allowing for the removal of acrylic paint 14 oversprayed on the surrounding nail tissue and cuticle through washing 28 with soap and water. The top coat is applied on in a manner consistent with current practice of nail enamels.

Figure 5:
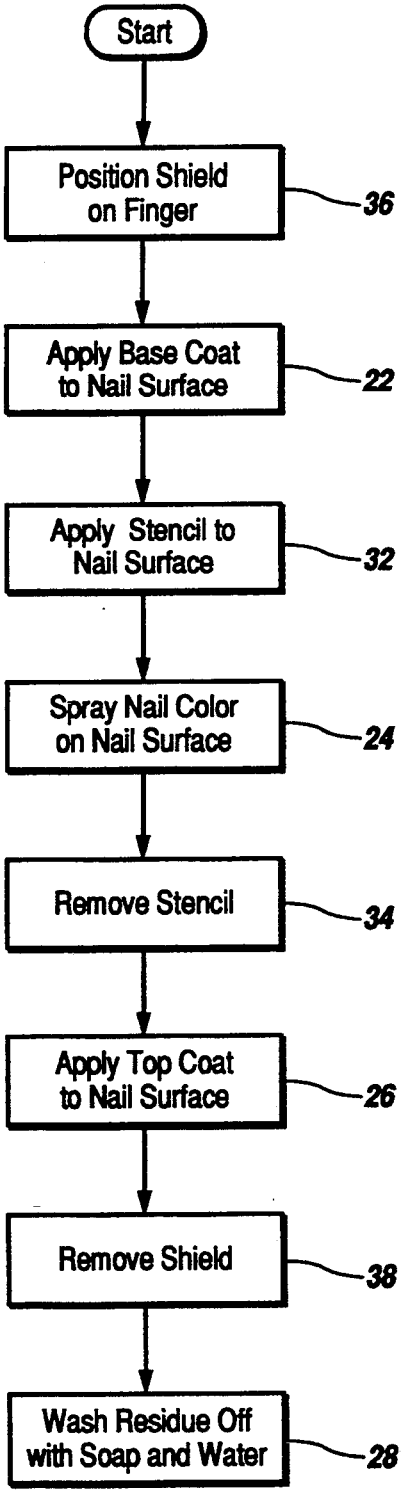
FIG. 5 is a flow chart showing the method for applying spray-on nail polish with the use of a shield and stencil design.

Additional steps necessary when using a shield 18 or stencil 30 are shown in FIG. 5. The stencil 30 is positioned 26 on the acrylic paint 14 coated nail surface or the base coated nail surface, prior to the top coat being applied 26. A coat of acrylic paint 14 is then applied 24 to enhance the stencil design. After allowing for the acrylic paint 14 color application to dry or partially dry, the stencil 30 is removed 34 from the nail surface leaving a well defined design on the nail surface. Once the desired nail design is achieved either through the use of numerous colors of acrylic paint 14 in a fading in and fading out technique or through the use of various stencils 30, the top coat is applied 26 to seal and waterproof the acrylic paint 14 coated nail surface. In addition, as an additional or alternate step, shown in FIG. 6 is the step of positioning 36 a finger shield 18 about the nail surface and subsequently removing 38 the finger shield 18 once the complete process of color application to the nail surface has been completed.

It will be apparent to those skilled in the art, that the foregoing detailed description of the preferred embodiment of the present invention is representative of a method for applying spray-on nail polish within the scope and spirit of the present invention. Further, those skilled in the art will recognize that various changes and modifications may be made without departing from the true spirit and scope of the present invention. Those skilled in the art will recognize that the invention is not limited to the specifics as shown here, but is claimed in any form or modification falling within the scope of the appended claims. For that reason, the scope of the present invention is set forth in the following claims.

I claim:

1. A method of applying color to a nail surface comprising the steps of:

applying a base coat to at least one nail surface;

spraying at least one color of acrylic paint on said at least one nail surface; and applying a top coat over said at least one color of acrylic paint sprayed on said at least one nail surface to seal said at least on color of acrylic paint.

2. The method of claim 1, further comprising the step of removing overspray of said at least one color of acrylic paint, sprayed on surrounding nail tissue and cuticle of said at least one nail surface by washing with soap and water.

3. The method of claim 2, further comprising the step of placing an adhesive backed finger shield over said surrounding nail tissue and cuticle of said at least one nail surface prior to spraying of said at least one color of acrylic paint, to act as a releasable shield for overspray of said at least one color of acrylic paint.

4. The method of claim 3, further comprising the step of removing said finger shield from said surrounding nail tissue and cuticle of said at least one nail surface.

5. The method of claim 2, further comprising the step of placing an adhesive backed stencil design on said nail surface prior to said spraying at least one color of acrylic paint being sprayed on said at least one nail surface.

6. The method of claim 5, further comprising the step of spraying said at least one color of acrylic paint to said stencil design on said at least one nail surface.

7. A method of applying color to a nail comprising the steps of applying a base coat to at least one nail surface, spraying from an aerosol can at least one color of an acrylic paint on said at least one nail surface, applying with a brush a top coat over said at least one color of acrylic paint sprayed on said at least one nail surface, and removing said at least one color of acrylic paint from surrounding nail tissue and cuticle of said at least one nail surface by washing with soap and water.

8. The method of claim 7, further comprising the step of placing an adhesive backed finger shield, having a substantially oval-shaped aperture defined in one end, over said surrounding nail tissue and cuticle of said at least one nail surface prior to spraying of said acrylic paint, to act as a releasable shield for overspray of said acrylic paint.

9. The method of claim 7, further comprising the step of placing an adhesive backed stencil design on said at least one color-of acrylic paint sprayed on said at least one nail surface and spraying additional acrylic paint on said stencil design to create a design on said at least one nail surface.

10. The method of claim 7, further comprising the step of placing an adhesive backed stencil design on said nail surface, having applied thereon said base coat, and spraying at least one acrylic paint on said stencil design to create a design on said at least one nail surface.

11. The method of claim 7, further comprising the step of spraying said at least one color of acrylic paint in a manner to fade in and out of color on said at least one nail surface.

* * * * *

UNITED STATES PATENT AND TRADEMARK OFFICE

CERTIFICATE OF CORRECTION

PATENT NO. : 5,427,121
DATED : June 27, 1995
INVENTOR(S) : Joyce H. Polito

It is certified that error appears in the above-indentified patent and that said Letters Patent is hereby corrected as shown below:

In the Abstract, Line 7, after "top", insert --sealing --.

Column 2, Line 10 after "applied", insert --by brushing it--.

Column 5, Line 23, delete "with a brush".

Column 6, Line 12, after "color", delete "-".

Signed and Sealed this

Nineteenth Day of March, 1996

*Attest:*

*Attesting Officer*

BRUCE LEHMAN

*Commissioner of Patents and Trademarks*